US007189022B1

(12) United States Patent
Greer, Jr. et al.

(10) Patent No.: US 7,189,022 B1
(45) Date of Patent: Mar. 13, 2007

(54) TUBE WITH RESILIENT APPLICATOR AND SCRAPER FOR DISPENSING TEXTURE MATERIALS

(75) Inventors: Lester R. Greer, Jr., Bellingham, WA (US); Randal W. Hanson, Bellingham, WA (US)

(73) Assignee: Homax Products, Inc., Bellingham, WA (US)

( * ) Notice: Subject to any disclaimer, the term of this patent is extended or adjusted under 35 U.S.C. 154(b) by 18 days.

(21) Appl. No.: 11/175,776

(22) Filed: Jul. 5, 2005

Related U.S. Application Data

(63) Continuation-in-part of application No. 10/215,530, filed on Aug. 8, 2002, now Pat. No. 6,913,407.

(60) Provisional application No. 60/311,424, filed on Aug. 10, 2001.

(51) Int. Cl.
*B05C 11/00* (2006.01)

(52) U.S. Cl. ..... 401/266; 401/261; 401/195; 222/106

(58) Field of Classification Search ..... 401/130, 401/139, 195, 261, 262, 266; 222/106, 191, 222/192

See application file for complete search history.

(56) References Cited

U.S. PATENT DOCUMENTS

| | | | |
|---|---|---|---|
| 1,674,510 | A | 6/1928 | Hagman |
| 2,197,052 | A | 4/1940 | Lowen |
| 2,361,407 | A | 10/1944 | McNair |
| 2,962,743 | A | 12/1960 | Henriksson |
| 3,016,561 | A | 1/1962 | Hulsh |
| 3,032,803 | A | 5/1962 | Walshauser |
| 3,072,953 | A | 1/1963 | Bunke |
| 3,121,906 | A | 2/1964 | Hulsh |
| 3,135,007 | A | 6/1964 | Howell |
| 3,271,810 | A | 9/1966 | Raffe |
| 3,756,732 | A | 9/1973 | Stoffler |
| 3,797,946 | A | 3/1974 | Witzmann et al. |
| 4,123,005 | A | 10/1978 | Blunk |
| 4,364,521 | A | 12/1982 | Stankowitz |
| 4,674,903 | A | 6/1987 | Chen |
| 5,341,970 | A | 8/1994 | Woods |
| 5,577,851 | A | 11/1996 | Koptis |

(Continued)

FOREIGN PATENT DOCUMENTS

| | | |
|---|---|---|
| FR | 2792296 | 10/2000 |

(Continued)

OTHER PUBLICATIONS

Dap Inc., Dap Patch Stick product, 1994, Dayton OH.

*Primary Examiner*—Huyen Le
(74) *Attorney, Agent, or Firm*—Michael R. Schacht; Schacht Law Office, Inc.

(57) ABSTRACT

A dispensing system for patching an untextured portion of a destination surface to substantially match an existing structure of an existing sprayed on texture pattern on the destination surface surrounding the untextured portion. The dispensing system comprises a container, a sponge member, and a scraper member. Texture material is arranged within the container. The sponge member defines an applicator surface and a sponge opening. The sponge member is secured to the container such that the container opening and sponge opening are substantially aligned. The scraper member is detachably attached to the container.

17 Claims, 8 Drawing Sheets

U.S. PATENT DOCUMENTS

| | | | | |
|---|---|---|---|---|
| 5,638,990 | A * | 6/1997 | Kastberg | 222/106 |
| 5,695,788 | A | 12/1997 | Woods | |
| 5,988,923 | A | 11/1999 | Arai | |
| 6,334,727 | B1 | 1/2002 | Gueret | |

FOREIGN PATENT DOCUMENTS

| | | |
|---|---|---|
| WO | WO 89/04796 | 6/1989 |

* cited by examiner

TUBE WITH RESILIENT APPLICATOR AND SCRAPER FOR DISPENSING TEXTURE MATERIALS

RELATED APPLICATIONS

This application is a continuation-in-part of U.S. patent application Ser. No. 10/215,530 filed on Aug. 8, 2002, now U.S. Pat. No. 6,913,407, which claimed priority of U.S. Provisional Patent Application Ser. No. 60/311,424, which was filed on Aug. 10, 2001.

TECHNICAL FIELD

The present invention relates to the application of coating materials and, in particular, to the systems and methods for dispensing texture material containing particulate material to a surface such as a ceiling or wall.

BACKGROUND OF THE INVENTION

To form walls, modern building methods typically employ sheets of wall material nailed and/or screwed to wall studs. The wall material may be coated with a texture material appropriate for either interior or exterior walls.

Texture materials can be applied to a destination surface in a number of different ways. For large surface areas, the texture material is typically applied with a sprayer system. Sprayer systems may be airless or may mix the texture material with a stream of pressurized air. The source of pressurized air may be a compressor, storage tank, or hand operated pump.

In other cases, such as touch up or repair of a wall or ceiling surface, only a small area need be covered with texture material. For small surfaces areas, the texture material is preferably dispensed using an aerosol system. Aerosol systems typically employ a container assembly, valve assembly, nozzle assembly, and propellant. The propellant pressurizes the texture material within the container such that, when the valve is opened, the texture material flows out of the nozzle assembly. The nozzle assembly is typically designed to deposit the texture material on the destination surface in selected one of a plurality of predetermined texture patterns.

The present invention is of particular relevance to the application of stucco and acoustic or "popcorn" texture materials to small surface areas, and those applications will be described herein in detail. Acoustic and stucco texture materials contain, in addition to a carrier and base, what will be referred to herein as a "particulate" material. The term "particulate texture material" will be used herein to refer to stucco material, acoustic texture, and similar wall coating materials containing particulate material.

The particulate material in acoustic texture material is typically formed by polystyrene chips, but other materials, such as cork, rubber, or the like, may also be used. Typical particulate materials exhibit desirable sound absorption qualities that give acoustic texture material its name. The particulate material in stucco is typically formed by sand or other similar materials.

The need exists for improved systems and methods for applying particulate texture material to relatively small surface areas.

SUMMARY OF THE INVENTION

The present invention may be embodied as a system for or method of patching a destination surface to match an existing texture pattern. The dispensing system comprises a container, a sponge member, and a scraper member. Texture material is arranged within the container. The sponge member defines an applicator surface and a sponge opening. The sponge member is secured to the container such that the container opening and sponge opening are substantially aligned. The scraper member is detachably attached to the container.

DETAILED DESCRIPTION OF THE INVENTION

Figure 1:
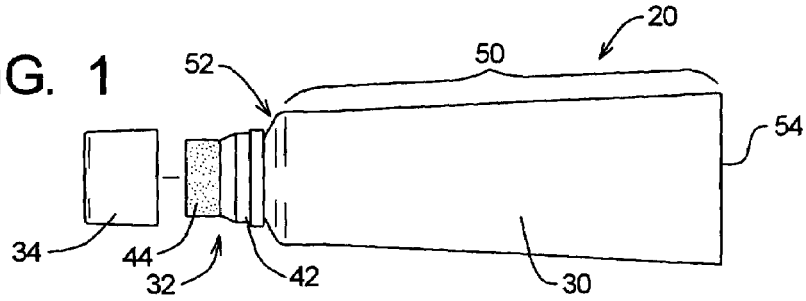
FIG. 1 is an elevational view depicting a dispensing system constructed in accordance with, and embodying the principals in the present invention.
Figure 2:
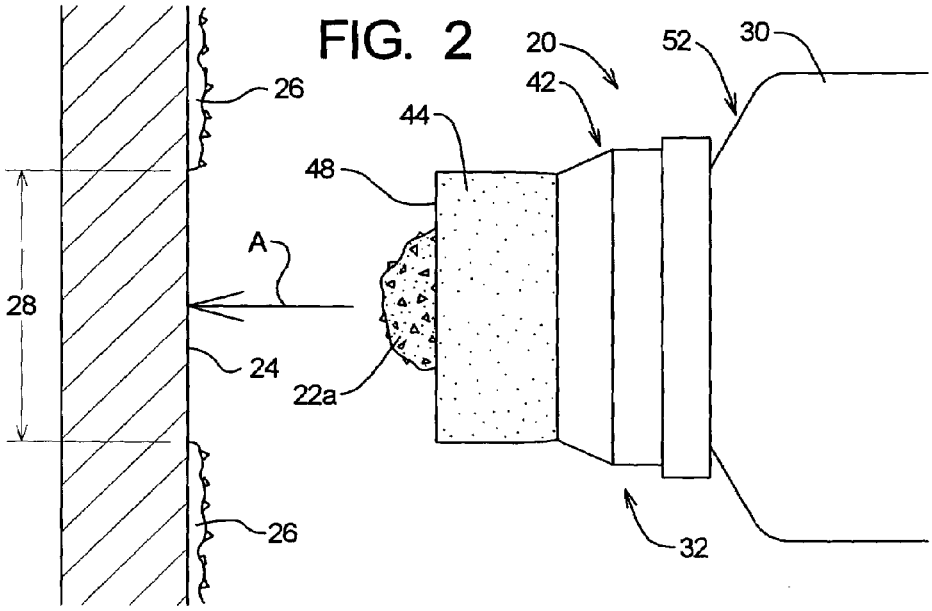
FIGS. 2 and 3 depict a method of using the system shown in FIG. 1 to apply texture material to a wall or ceiling surface.
Figure 3:
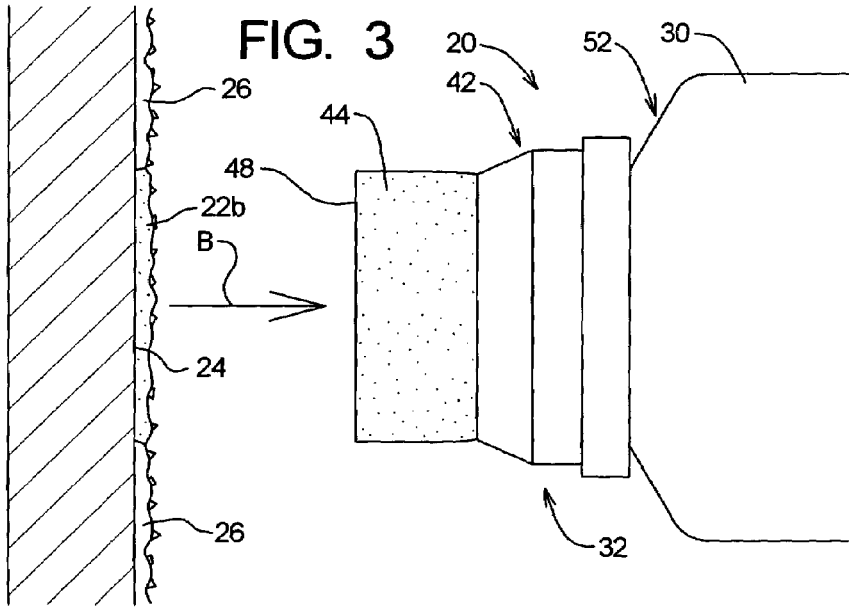

Referring initially to FIGS. 1–5, depicted therein is a first embodiment of a dispensing system 20 constructed in accordance with, and embodying, the principals of the present invention. As shown in FIGS. 2 and 3, the dispensing system 20 is used to apply new texture material 22 to a wall or ceiling surface 24. Existing material 26 is present on the exemplary surface 24, and an area 28 to be patched is shown in FIG. 2. The dispensing system 20 is of particular significance in the context of patching the area 28 of the wall surface 24 to match the existing texture material 26.

FIG. 2 also shows new texture material, indicated by reference character 22*a*, in the process of being dispensed from the system 20. FIG. 3 shows, as indicated by reference character 22*b*, the new texture material 22 applied to the surface 24 over the area 28 to be patched.

Texture material typically comprises a base 36, a particulate 38, and a carrier 40. The base 36 typically comprises a binder, a pigment, and filler material. The binder binds the remaining materials together and to the surface 24 to be coated. The pigment provides color to the applied coating.

The filler is typically an inexpensive material that provides bulk to the coating without interfering with the function of the pigment or binder.

The particulate 38 in the texture material of the present invention is large enough to be visible to the unaided eye. The particulate 38 is typically sand, perlite, cork, polystyrene chips, foam, or the like. The particulate 38 provides a desirable aesthetic "look" and in some cases a functional purpose such as wear resistance or sound deadening. In the example dispensing system 20 depicted in FIGS. 1–5, the texture material 22 is acoustic texture material, and the particulate 38 is formed by cork, polystyrene, urethane foam, melamine foam, or the like.

The carrier 40 is typically oil or water that forms a solvent for the base 36 and thus allows the materials 22 to be in a liquid or plastic form when not exposed to air. Exposure to air causes the carrier 40 to evaporate or dry, leaving the base in a hardened form. The carrier 40 is represented by dots in the drawings; no dots are used when the texture material depicted has hardened.

In the following discussion, the physical structure of the dispensing system 20 will be described in further detail. Following that, a method of using the dispensing system 20 to apply the new texture material 22 to the surface 24 will be described in detail.

Figure 4:
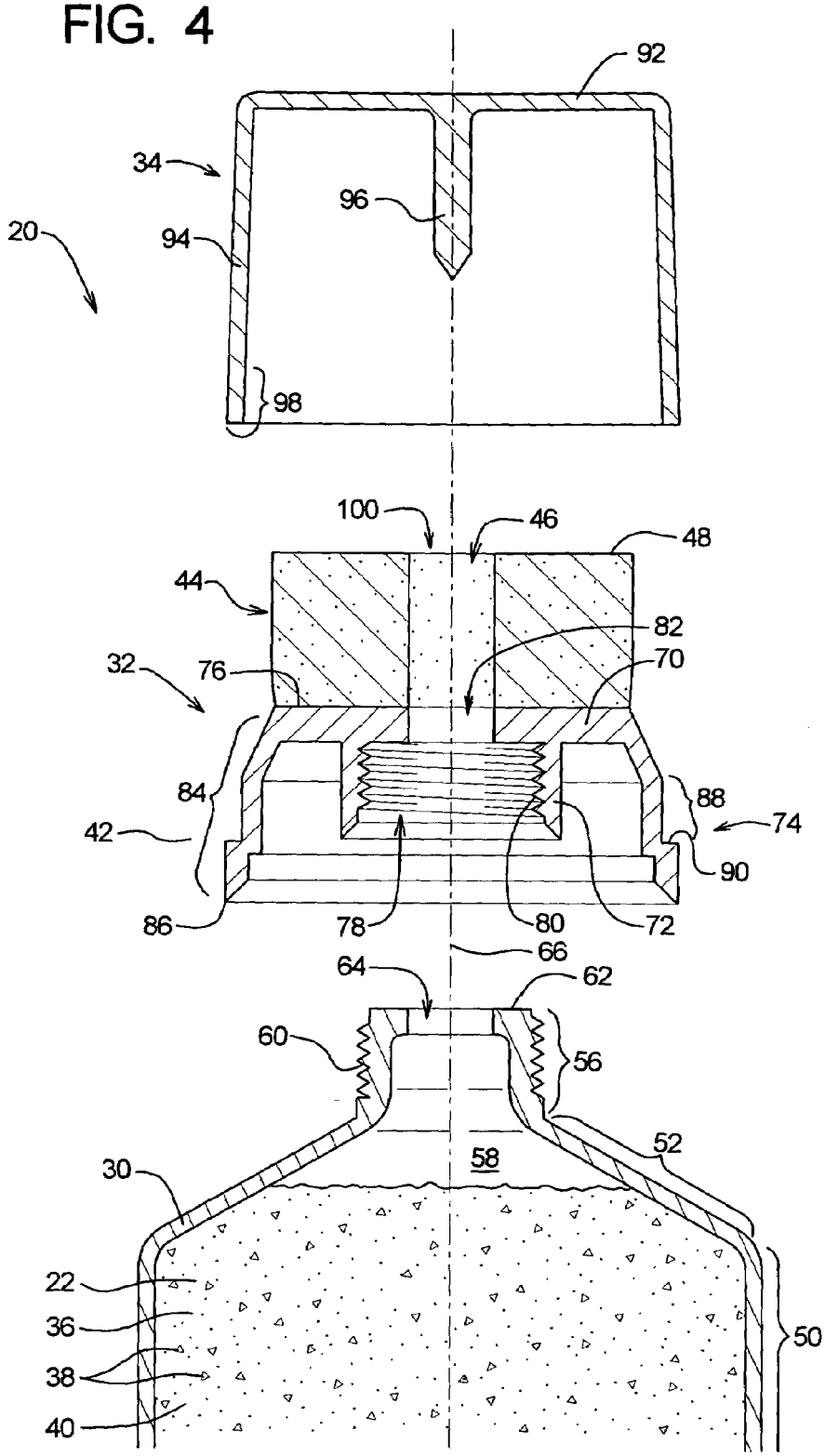
FIG. 4 is an exploded section view depicting a portion of the dispensing system of FIG. 1.
Figure 5:
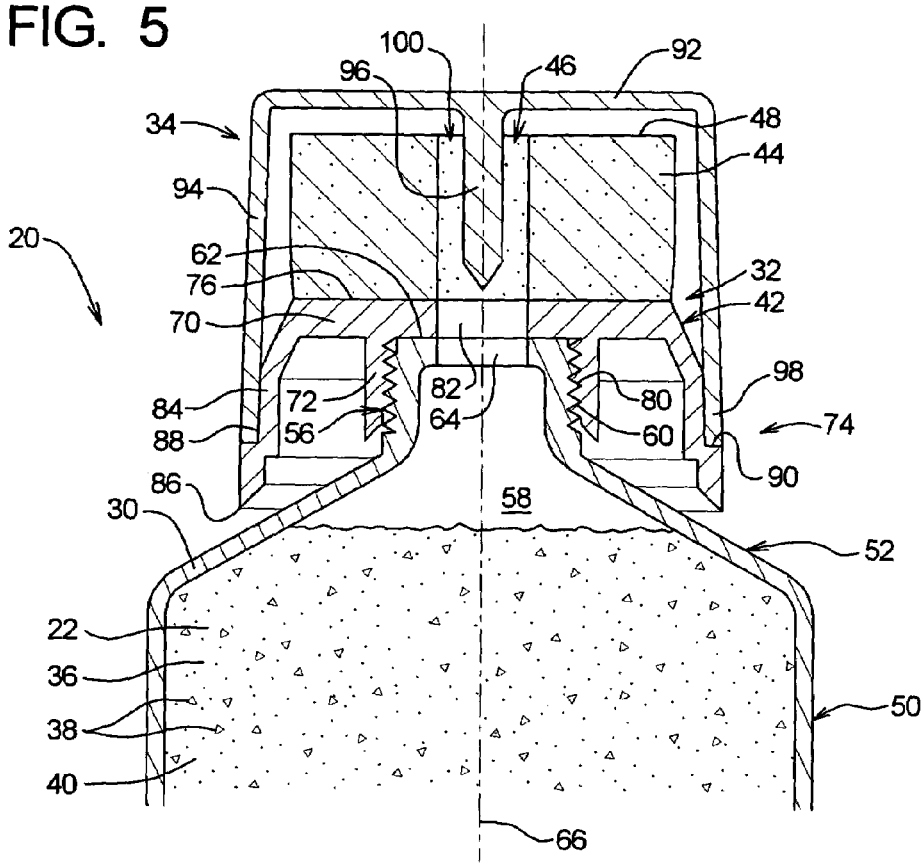
FIG. 5 is a section view depicting a portion of the dispensing system of FIG. 1.
Figure 6:
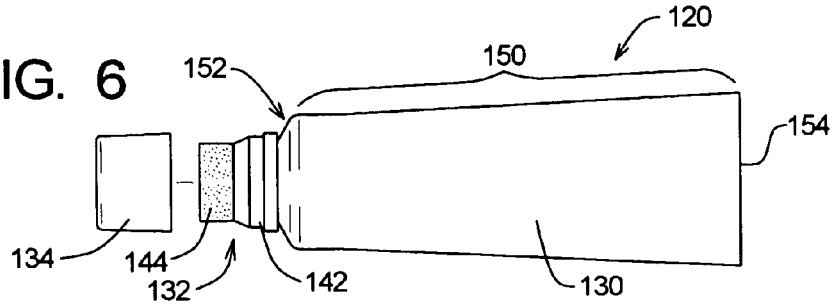
FIG. 6 is an elevational view depicting a dispensing system constructed in accordance with, and embodying the principals in the present invention.

Referring now to FIGS. 4 and 5, it can be seen that the exemplary dispensing system 20 comprises a container 30, a sponge assembly 32, and a cap member 34. The exemplary sponge assembly 32 comprises a sponge base 42 and sponge member 44. The sponge member 44 defines a sponge opening 46 and an applicator surface 48. The exemplary sponge base 42 is made of rigid plastic and is adapted to engage both the container 30 and the cap member 34. The sponge member 44 is relatively resilient and is secured by adhesive or the like to the sponge base 42.

The sponge base 42 and sponge member 44 of the exemplary sponge assembly 32 are made of different materials. In particular, the sponge base 42 is made of a relatively rigid plastic and the sponge member 44 is made of a resilient material such as synthetic or natural sponge or foam. This use of two different materials for the parts 42 and 44 simplifies the manufacturing process and reduces cost, but one of ordinary skill in the art will recognize that certain materials and manufacturing techniques may be used to manufacture the sponge assembly 32 out of a single piece of material. In this case, the sponge base 42 and sponge member 44 would be integrally formed and not separate members secured together as in the exemplary embodiment described herein. The exemplary sponge base 42 and sponge member 44 will be described in further detail below.

Referring now for a moment to FIG. 1, it can be seen that the container 30 comprises a main portion 50, a shoulder portion 52, and a closed end 54. FIGS. 4 and 5 show that the container 30 also comprises an opening portion 56.

The container 30 is preferably made of a soft or resilient plastic material that is substantially impermeable to air and can be deformed by squeezing by hand. Other materials, such as paper, paperboard, metal, or the like may be used.

The exemplary main portion 50 starts out during manufacture as a cylindrical tube having a fill opening at one end and the shoulder and opening portions 52 and 56 at the other end. The new texture material 22 is introduced into a container chamber 58 defined by the container 30. The fill opening is then closed to form the closed end 54.

Formed on the opening portion 56 is an external threaded surface 60 and a dispensing surface 62. A container opening 64 is formed in the dispensing surface 62. When the closed end 54 is formed, the new texture material 22 in the material chamber 58 may thus exit the container 30 only through the container opening 64. A dispensing axis 66 extends through the container opening 64. In the exemplary system 20, the opening portion 56 and container opening 64 are generally cylindrical and their longitudinal axes are aligned with each other and with the dispensing axis 66.

As shown in the drawing, again with reference to FIGS. 4 and 5, the sponge base 42 comprises a plate portion 70, a mounting portion 72, and a skirt portion 74. The plate portion 70 defines a sponge surface 76 to which is attached the sponge member 44.

The mounting portion 72 defines a mounting cavity 78 having an internal threaded surface 80. The external threaded surface 60 and internal threaded surface 80 are complimentary such that the sponge base 42 may be threaded onto the container 30 to attach the sponge assembly 32 to the container 30.

A base opening 82 is formed in the sponge base 42. In particular, the base opening 82 extends from the sponge surface 76 to the mounting cavity 78. When the threaded surfaces 60 and 80 are engaged with each other, the base opening 82 is substantially aligned with the container opening 64. In addition, with the sponge member 44 secured to the sponge surface 76, the sponge opening 46 is also substantially aligned with the base opening 82.

The skirt portion 74 of the sponge base 42 comprises a side wall 84 defining a skirt edge 86. The side wall 84 extends downwardly from the plate portion 70 around the mounting portion 72. A cap surface 88 is formed on the side wall 84. A stop portion 90 of the cap surface 88 extends radially outwardly from the side wall 84.

The exemplary cap member 34 is or may be conventional in that it comprises a disc portion 92 and a wall portion 94. The exemplary cap member 34 further comprises a pin portion 96 that extends from the disc portion 92 within the wall portion 94. The wall portion 94 further defines an edge portion 98.

The cap member 34 may be selectively attached to or detached form the sponge assembly 32 by engaging the edge portion 98 of the cap member wall portion 94 with the side wall 84 formed on the skirt portion 74 of the sponge base 42. The edge portion 98 engages the stop portion 90 when the cap member 34 is secured to the sponge assembly 32. However, the edge portion 98 engages the cap surface 88 such that deliberate application of manual force on the cap member 34 can remove the cap member 34 from the sponge assembly 32.

Other systems and methods may be used to secure the cap member 34 relative to the sponge assembly 32. For example, complimentary threaded portions may be formed on the cap surface 88 and the edge portion 98 such that the cap member 34 is threaded onto the sponge assembly 32. Alternatively, the cap member 34 may be oversized such that it extends completely over the sponge assembly 32 and directly engages the container 30, preferably at the transition between the shoulder portion 52 and the main portion 50 of the container 30. If the cap member 34 directly engages the container 30, the skirt portion 74 of the sponge base 42 may be eliminated. The cap member 34 is not essential to the principals of the present invention, and the present invention may be embodied in a dispensing system 20 without a cap member.

When the edge portion 98 of the cap member 34 engages the cap surface 88 of the sponge base 42, the pin portion 96 extends into the sponge opening 46 in the sponge member 44. The pin portion 96 removes at least a portion of the dried texture material 22 within the sponge opening 46 and thus facilitates re-use of the system 20 after it has initially been opened.

With the sponge member 44 secured to the sponge surface 76 and the complimentary threaded surfaces 60 and 80 securing the sponge assembly 32 onto the container 30, the aligned sponge opening 46, base opening 82, and container opening 64 define a dispensing passageway 100 that allows material to flow out of the material chamber 58.

With the foregoing understanding of the dispensing system 20 in mind, the method of use of this system 20 will now be described in detail. Initially, the area 28 to be patched is preferably cleaned and otherwise primed or prepared, although the present invention may be implemented without this preliminary step.

The main portion 50 of the container 30 is then squeezed by hand or other method such that the container 30 deforms and the new texture material 22 is forced along the dispensing passageway 100 and onto the applicator surface 48.

As shown in FIG. 2, reference character 22*a* identifies a small portion of the new texture material 22 on the applicator surface 48. The entire container 30 is then displaced in the direction of arrow A such that the texture material 22*a* comes into contact with the surface 24 at the area 28 to be patched. Surface tension will cause at least a portion of the texture material 22*a* to adhere to the surface 24. At this point, the container 30 is displaced away from the surface 24 in the direction shown by arrow B, leaving a portion 22*b* of the new texture material 22 on the surface 24 at the area 28 to be patched.

The process of squeezing the container 30 to cause the texture material 22*a* to accumulate on the applicator surface 48, displacing the container assembly 30 as shown by arrow A such that the material 22*a* is deposited on the surface 24, and then withdrawing the container 30 in the direction shown by arrow B is repeated until the entire area 28 to be patched is covered with the texture material 22*b*.

The compressibility of the sponge member 44 is of significance in that the sponge member 44 does not define rigid edges or surfaces that will scrape and thus flatten the particulate within the texture material 22. In addition, the texture material 22*a* is daubed onto the surface 24 such that particulate material within the texture material 22 projects from the surface 24 in a manner similar to that obtained by an application process involving spraying. The daubing action used to apply the texture material 22 is substantially straight toward the surface 24 along the arrow A and substantially straight away from the surface 24 along the arrow B. The sponge member 44 is not wiped against the surface 24 during normal use.

To the contrary, a wiping action (movement substantially perpendicular to the direction shown by arrows A and B), would orient the particulate in the texture material 22 such that the particulate 38 is pressed into and embedded within the material 22 and does not extend from the surface 24. Again, the idea is to match the existing texture material 26, which in the vast majority of cases will have been blown or sprayed on using an air sprayer. The blowing process allows the particulate 38 to project out from the surface 24.

Clearly, the cap member 34 must be removed while the system 20 is used to apply the texture material 22 to the surface 24. After the first time the system 20 is used, the cap member 34 is fixed relative to the container such that the cap member 34 protects the sponge member 44 and facilitates re-use of the system 20 at a later time.

In particular, the dispensing system 20 is preferably distributed and sold with the container opening 64 unformed or possibly with an adhesive tab covering the container opening 64. If the container opening is unformed during distribution and sale, the opening 64 is formed by the end user immediately prior to use by piercing the surface 62 with a sharp object such as a knife, nail, screw driver or the life. If an adhesive tab is used, the user detaches the sponge assembly 32 from the container 30, removes the removable tab, and reattaches the sponge assembly 32 to the container 30.

Once the factory seal on the container opening 64 is broken by a method such as just described, air may infiltrate the material chamber 58 through this opening 64 and cause the material 22 therein to harden. The cap member 34 substantially seals the opening 64 and thus prolongs the life of the dispensing system 20 after it has initially been opened.

From the foregoing, it should be apparent that the present invention may be embodied in forms other than that described above without departing from the principals of the present invention. For example, the various components 30, 34, 42, and 44 are generally symmetrical about the dispensing axis 66. (e.g. cylindrical or frusta-conical or define cylindrical or frusta-conical surfaces). This configuration of parts is relatively easy to manufacture and is thus preferred. However, the present invention may be embodied with forms that are not symmetrical about an axis of rotation, and such other forms are considered within the scope of the present invention.

In addition, containers other than the exemplary container 30 described herein may be used. For example, cylindrical cartridges with a floating piston member are often used to dispense materials of this type. Such cartridges are placed into a squeeze gun that contains a ratchet mechanism that acts on the floating piston member to force the material out of the opening. This type of arrangement could also be used in conjunction with the principals of the present invention to apply more viscous texture materials such as stucco or the like to wall surfaces.

Figure 7:
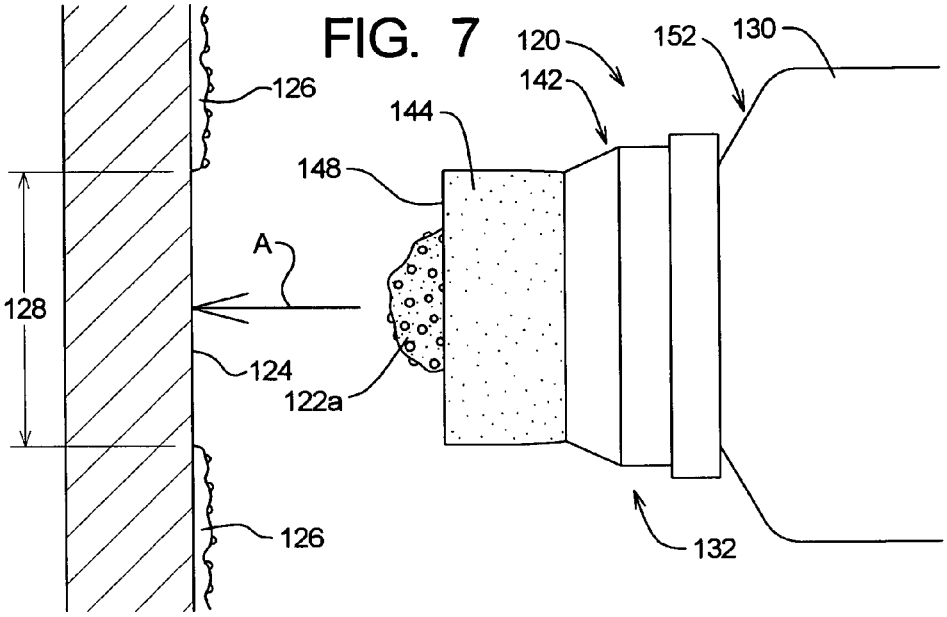
FIGS. 7 and 8 depict a method of using the system shown in FIG. 6 to apply texture material to a wall or ceiling surface.
Figure 8:
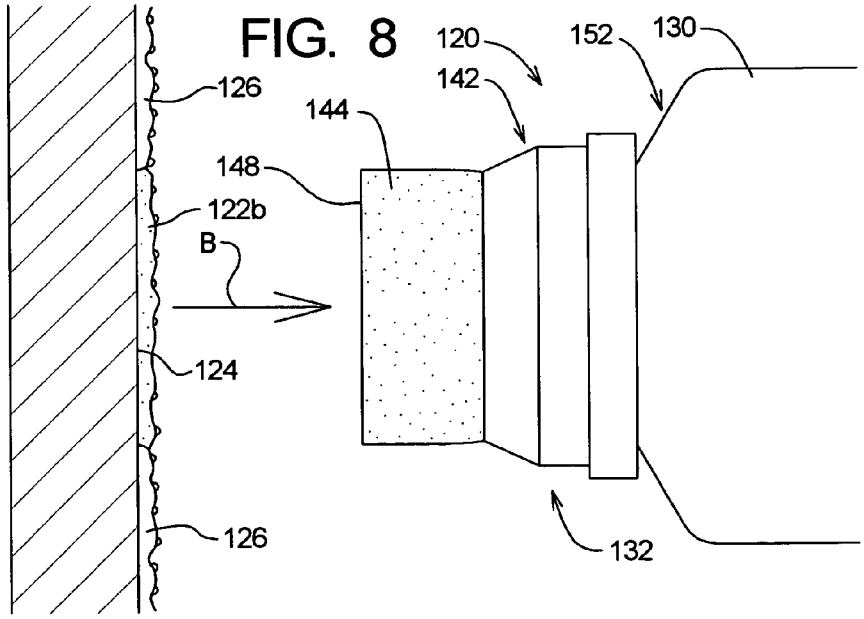

Referring now to FIGS. 6–13, depicted at 120 therein is a second embodiment of a dispensing system constructed in accordance with, and embodying, the principals of the present invention. As shown in FIGS. 7 and 8, the dispensing system 120 is used to apply new texture material 122 to a wall or ceiling surface 124. Existing material 126 is present on the exemplary surface 124, and an area 128 to be patched is shown in FIG. 7. The dispensing system 120 is of particular significance in the context of patching the area 128 of the wall surface 124 to match the existing texture material 126.

FIG. 7 also shows new texture material, indicated by reference character 122*a*, in the process of being dispensed from the system 120. FIG. 8 shows, as indicated by reference character 122*b*, the new texture material 122 applied to the surface 124 over the area 128 to be patched.

Texture material typically comprises a base 136, a particulate 138, and a carrier 140. The base 136 typically comprises a binder, a pigment, and filler material. The binder binds the remaining materials together and to the surface 124 to be coated. The pigment provides color to the applied coating. The filler is typically an inexpensive material that provides bulk to the coating without interfering with the function of the pigment or binder.

The particulate 138 in the texture material of the present invention is large enough to be visible to the unaided eye. The particulate 138 is typically sand, perlite, cork, polystyrene chips, foam, or the like. The particulate 138 provides a desirable aesthetic "look" and in some cases a functional purpose such as wear resistance or sound deadening. In the example dispensing system 120 depicted in FIGS. 6–13, the texture material 122 is stucco material, and the particulate 138 is formed by sand, perlite, or the like.

The carrier 140 is typically oil or water that forms a solvent for the base 136 and thus allows the materials 122 to be in a liquid or plastic form when not exposed to air. Exposure to air causes the carrier 140 to evaporate or dry, leaving the base in a hardened form. The carrier 140 is represented by dots in the drawings; no dots are used when the texture material depicted has hardened.

In the following discussion, the physical structure of the dispensing system 120 will be described in further detail. Following that, a method of using the dispensing system 120 to apply the new texture material 122 to the surface 124 will be described in detail.

Figure 9:
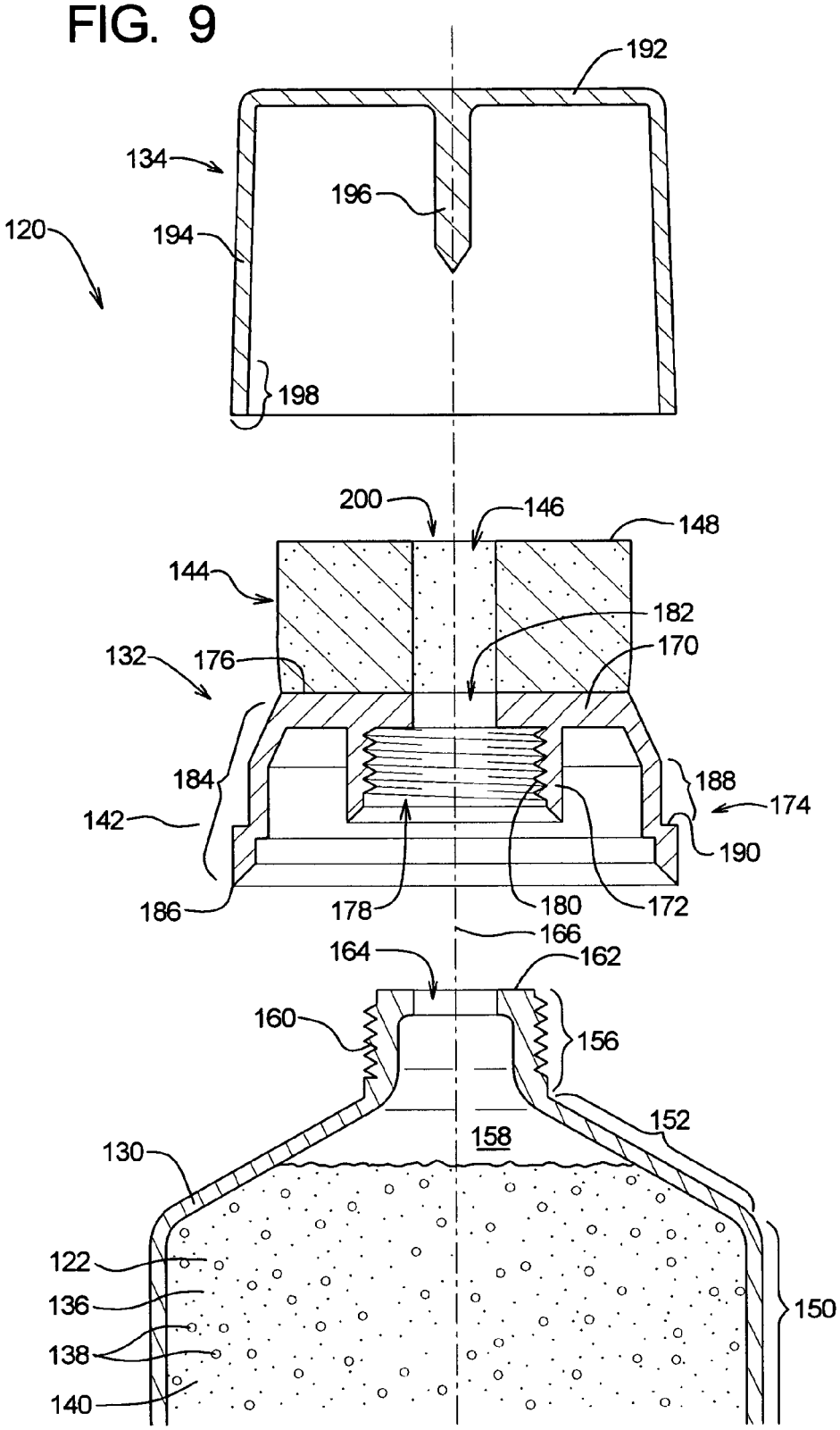
FIG. 9 is an exploded section view depicting a portion of the dispensing system of FIG. 6.
Figure 10:
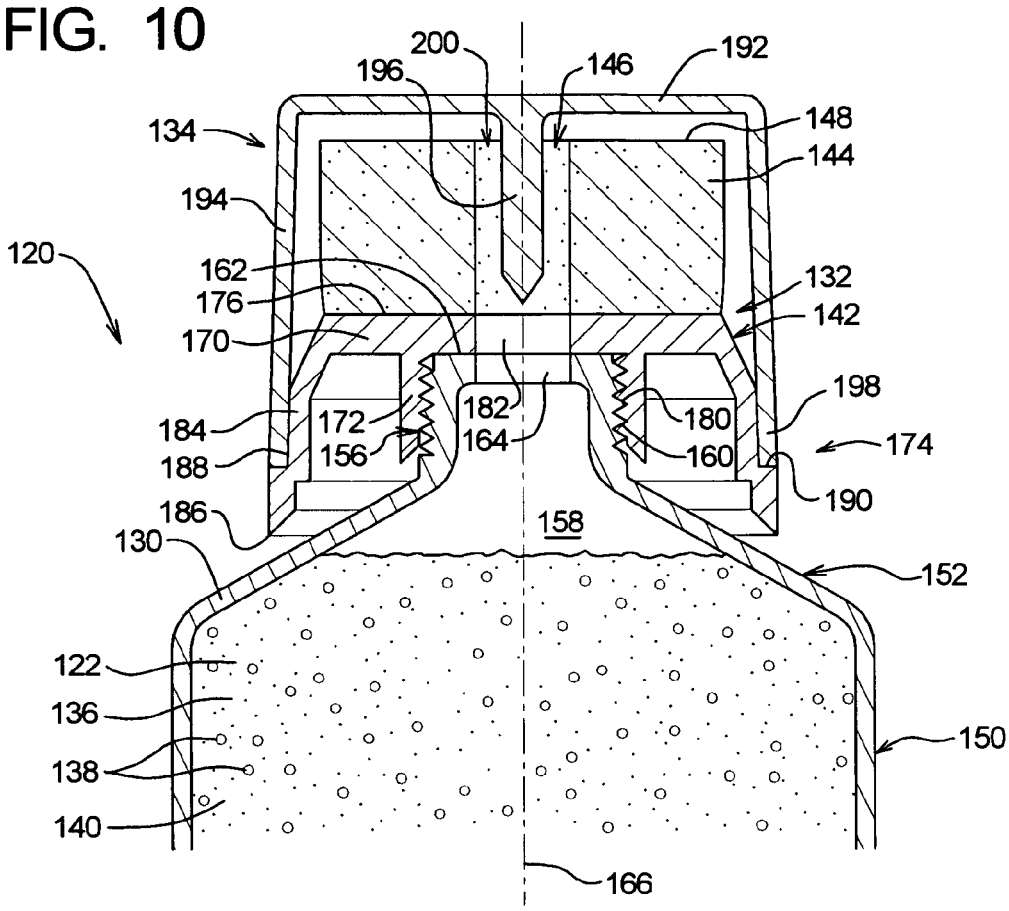
FIG. 10 is a section view depicting a portion of the dispensing system of FIG. 6.

Referring now to FIGS. 9 and 10, it can be seen that the exemplary dispensing system 120 comprises a container 130, a sponge assembly 132, and a cap member 134. The exemplary sponge assembly 132 comprises a sponge base 142 and sponge member 144. The sponge member 144 defines a sponge opening 146 and an applicator surface 148. The exemplary sponge base 142 is made of rigid plastic and is adapted to engage both the container 130 and the cap member 134. The sponge member 144 is relatively resilient and is secured by adhesive or the like to the sponge base 142.

The sponge base 142 and sponge member 144 of the exemplary sponge assembly 132 are made of different materials. In particular, the sponge base 142 is made of a relatively rigid plastic and the sponge member 144 is made of a resilient material such as synthetic or natural sponge or foam. This use of two different materials for the parts 142 and 144 simplifies the manufacturing process and reduces cost, but one of ordinary skill in the art will recognize that certain materials and manufacturing techniques may be used to manufacture the sponge assembly 132 out of a single piece of material. In this case, the sponge base 142 and sponge member 144 would be integrally formed and not separate members secured together as in the exemplary embodiment described herein. The exemplary sponge base 142 and sponge member 144 will be described in further detail below.

Referring now for a moment to FIG. 1, it can be seen that the container 130 comprises a main portion 150, a shoulder portion 152, and a closed end 154. FIGS. 4 and 5 show that the container 130 also comprises an opening portion 156.

The container 130 is preferably made of a soft or resilient plastic material that is substantially impermeable to air and can be deformed by squeezing by hand. Other materials, such as paper, paperboard, metal, or the like may be used.

The exemplary main portion 150 starts out during manufacture as a cylindrical tube having a fill opening at one end and the shoulder and opening portions 152 and 156 at the other end. The new texture material 122 is introduced into a container chamber 158 defined by the container 130. The fill opening is then closed to form the closed end 154.

Formed on the opening portion 156 is an external threaded surface 160 and a dispensing surface 162. A container opening 164 is formed in the dispensing surface 162. When the closed end 154 is formed, the new texture material 122 in the material chamber 158 may thus exit the container 130 only through the container opening 164. A dispensing axis 166 extends through the container opening 164. In the exemplary system 120, the opening portion 156 and container opening 164 are generally cylindrical and their longitudinal axes are aligned with each other and with the dispensing axis 166.

As shown in the drawing, again with reference to FIGS. 4 and 5, the sponge base 142 comprises a plate portion 170, a mounting portion 172, and a skirt portion 174. The plate portion 170 defines a sponge surface 176 to which is attached the sponge member 144.

The mounting portion 172 defines a mounting cavity 178 having an internal threaded surface 180. The external threaded surface 160 and internal threaded surface 180 are complimentary such that the sponge base 142 may be threaded onto the container 130 to attach the sponge assembly 132 to the container 130.

A base opening 182 is formed in the sponge base 142. In particular, the base opening 182 extends from the sponge surface 176 to the mounting cavity 178. When the threaded surfaces 160 and 180 are engaged with each other, the base opening 182 is substantially aligned with the container opening 164. In addition, with the sponge member 144 secured to the sponge surface 176, the sponge opening 146 is also substantially aligned with the base opening 182.

The skirt portion 174 of the sponge base 142 comprises a side wall 184 defining a skirt edge 186. The side wall 184 extends downwardly from the plate portion 170 around the mounting portion 172. A cap surface 188 is formed on the side wall 184. A stop portion 190 of the cap surface 188 extends radially outwardly from the side wall 184.

The exemplary cap member 134 is or may be conventional in that it comprises a disc portion 192 and a wall portion 194. The exemplary cap member 134 further comprises a pin portion 196 that extends from the disc portion 192 within the wall portion 194. The wall portion 194 further defines an edge portion 198.

The cap member 134 may be selectively attached to or detached form the sponge assembly 132 by engaging the edge portion 198 of the cap member wall portion 194 with the side wall 184 formed on the skirt portion 174 of the sponge base 142. The edge portion 198 engages the stop portion 190 when the cap member 134 is secured to the sponge assembly 132. However, the edge portion 198 engages the cap surface 188 such that deliberate application of manual force on the cap member 134 can remove the cap member 134 from the sponge assembly 132.

Other systems and methods may be used to secure the cap member 134 relative to the sponge assembly 132. For example, complimentary threaded portions may be formed on the cap surface 188 and the edge portion 198 such that the cap member 134 is threaded onto the sponge assembly 132. Alternatively, the cap member 134 may be oversized such that it extends completely over the sponge assembly 132 and directly engages the container 130, preferably at the transition between the shoulder portion 152 and the main portion 150 of the container 130. If the cap member 134 directly engages the container 130, the skirt portion 174 of the sponge base 142 may be eliminated. The cap member 134 is not essential to the principals of the present invention, and the present invention may be embodied in a dispensing system 120 without a cap member.

When the edge portion 198 of the cap member 134 engages the cap surface 188 of the sponge base 142, the pin portion 196 extends into the sponge opening 146 in the sponge member 144. The pin portion 196 removes at least a portion of the dried texture material 122 within the sponge opening 146 and thus facilitates re-use of the system 120 after it has initially been opened.

With the sponge member 144 secured to the sponge surface 176 and the complimentary threaded surfaces 160 and 180 securing the sponge assembly 132 onto the container 130, the aligned sponge opening 146, base opening 182, and container opening 164 define a dispensing passageway 100 that allows material to flow out of the material chamber 158.

With the foregoing understanding of the dispensing system 120 in mind, the method of use of this system 120 will now be described in detail. Initially, the area 128 to be patched is preferably cleaned and otherwise primed or prepared, although the present invention may be implemented without this preliminary step.

The main portion 150 of the container 130 is then squeezed by hand or other method such that the container 130 deforms and the new texture material 122 is forced along the dispensing passageway 100 and onto the applicator surface 148.

As shown in FIG. 7, reference character 122*a* identifies a small portion of the new texture material 122 on the applicator surface 148. The entire container 130 is then displaced in the direction of arrow A such that the texture material 122*a* comes into contact with the surface 124 at the area 128 to be patched. Surface tension will cause at least a portion of the texture material 122*a* to adhere to the surface 124. At this point, the container 130 is displaced away from the surface 124 in the direction shown by arrow B, leaving a portion 122*b* of the new texture material 122 on the surface 124 at the area 128 to be patched.

The process of squeezing the container 130 to cause the texture material 122*a* to accumulate on the applicator surface 148, displacing the container assembly 130 as shown by arrow A such that the material 122*a* is deposited on the surface 124, and then withdrawing the container 130 in the direction shown by arrow B is repeated until the entire area 128 to be patched is covered with the texture material 122*b*.

The daubing action used to apply the texture material 122 is substantially straight toward the surface 124 along the arrow A and substantially straight away from the surface 124 along the arrow B. The sponge member 144 is not wiped against the surface 124 during normal use. During use of the system 120, the idea is to match the existing texture material 126, which in the vast majority of cases will have been blown or sprayed on using an air sprayer.

Clearly, the cap member 134 must be removed while the system 120 is used to apply the texture material 122 to the surface 124. After the first time the system 120 is used, the cap member 134 is fixed relative to the container such that the cap member 134 protects the sponge member 144 and facilitates re-use of the system 120 at a later time.

In particular, the dispensing system 120 is preferably distributed and sold with the container opening 164 unformed or possibly with an adhesive tab covering the container opening 164. If the container opening is unformed during distribution and sale, the opening 164 is formed by the end user immediately prior to use by piercing the surface 162 with a sharp object such as a knife, nail, screw driver or the life. If an adhesive tab is used, the user detaches the sponge assembly 132 from the container 130, removes the removable tab, and reattaches the sponge assembly 132 to the container 130.

Once the factory seal on the container opening 164 is broken by a method such as just described, air may infiltrate the material chamber 158 through this opening 164 and cause the material 122 therein to harden. The cap member 134 substantially seals the opening 164 and thus prolongs the life of the dispensing system 120 after it has initially been opened.

Figure 11:
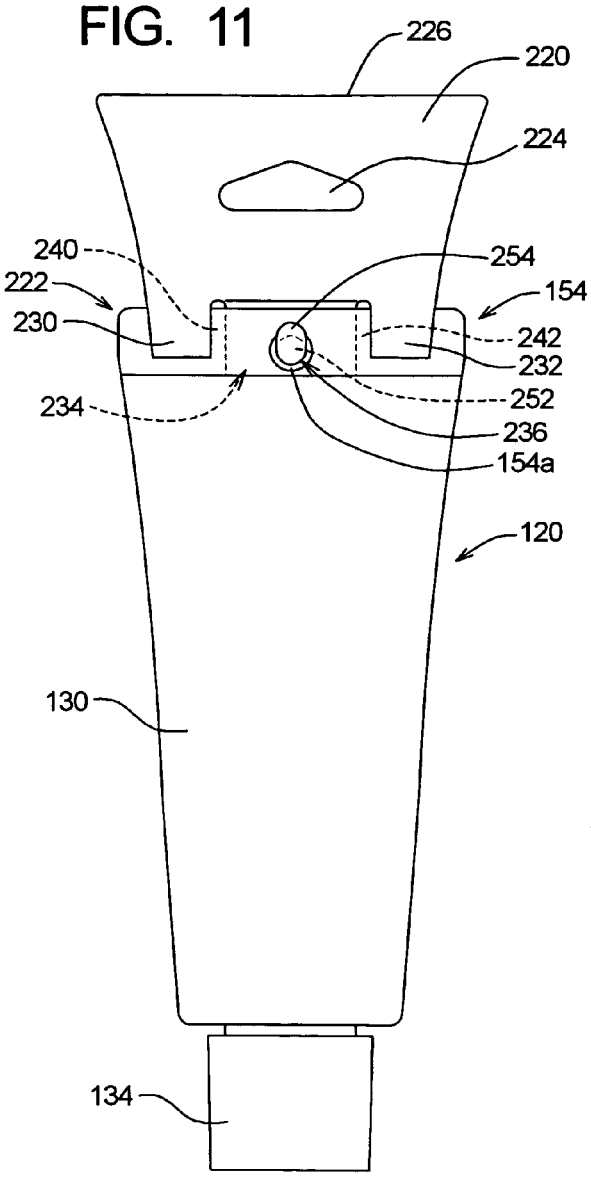
FIG. 11 is a front elevation view depicting an optional scraper member used by the dispensing system of FIG. 6.
Figure 12:
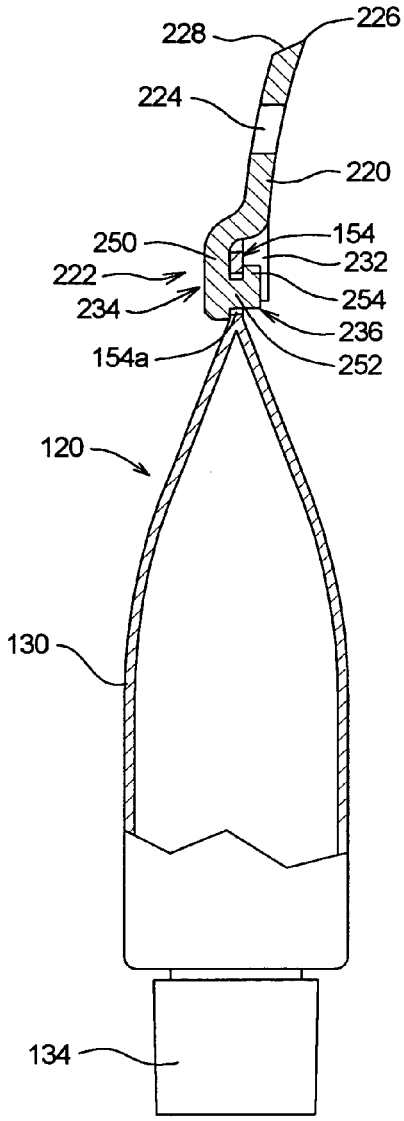
FIG. 12 is a side, partial cut-away, elevation view depicting the dispensing system of FIG. 6 with the optional scraper member.
Figure 13:
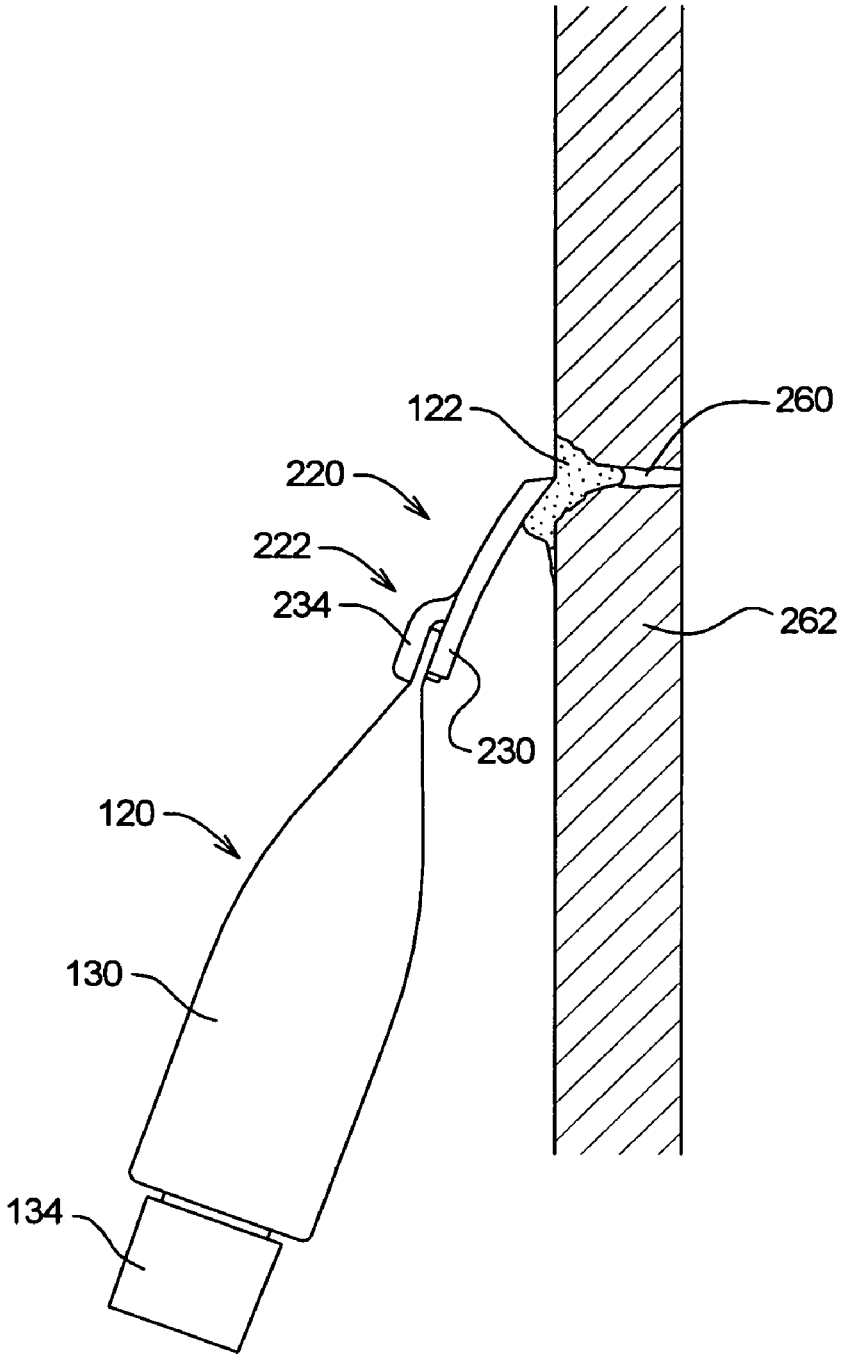
FIG. 13 is a side elevation view depicting one example use of the dispensing system and scraper member depicted in FIGS. 11 and 12.

FIGS. 11–13 illustrate that the example dispensing system 120 may further comprise a scraper member 220 defining a connecting portion 222, a display opening 224, and a scraper edge 226. A beveled surface 228 on the scraper member 220 yields a relatively sharp scraper edge. The connecting portion 222 of the scraper member 220 is configured to engage the closed end 154 to detachably attach the scraper member 220 to the container 130.

In particular, the connecting portion 222 defines first and second lateral portions 230 and 232 and a central portion 234. A latch projection 236 is formed on the central portion 234. The lateral portions 230 and 232 are separated from the central portion 234 by slots 240 and 242. The central portion 234 is offset from the lateral portions 230 and 232 as shown in FIG. 12. The latch projection 236 comprises a main body 250, an intermediate portion 252, and an engaging portion 254. A retaining opening 154*a* is formed in the closed end 154 of the container 130.

To attach the scraper member 220 to the container 130, the closed end 154 of the container 130 is inserted into the slots 240 and 242 in the scraper member 220 such that the lateral portions 230 and 232 are on a first side of the closed end 154 and the main body 250 of the central portion 234 is on a second side of the closed end 154. The intermediate portion 252 of the latch projection 236 extends through the retaining opening 154*a* such that the engaging portion 254 is also on the same side of the closed end 154 as the lateral portions 230 and 232. The scraper member 220 may be attached to and detached from the container 130 by slightly deforming the closed end 154 to allow the latch projection 236 to be inserted into and withdrawn from the retaining opening 154*a* with the closed end 154 within the slots 240 and 242.

The scraper member 220 is typically attached to the container 130 at the factory, but may be attached at the point of retail display or use. With the scraper member 220 attached to the container 130, a display hook (not shown) may be placed through the display opening 224 in a conventional manner to support the container 130 for retail display.

As shown in FIG. 13, the scraper member 220 may be used to work the texture material 122 after it has been dispensed from the system 120. In FIG. 13, the scraper member 220 is shown being used to work the texture material 122 into a crack 260 in a wall 262, but the scraper member 220 may be used to work the material 122 in other ways as well. In addition, the scraper member 220 may be used to work the material 122 when attached to the container 130 as shown in FIG. 13 or when detached from the container 130, depending upon the circumstances.

From the foregoing, it should be apparent that the present invention may be embodied in forms other than that described above without departing from the principals of the present invention. For example, the various components 130, 134, 142, and 144 are generally symmetrical about the dispensing axis 166. (e.g. cylindrical or frusta-conical or define cylindrical or frusta-conical surfaces). This configuration of parts is relatively easy to manufacture and is thus preferred. However, the present invention may be embodied with forms that are not symmetrical about an axis of rotation, and such other forms are considered within the scope of the present invention.

In addition, containers other than the exemplary container 130 described herein may be used. For example, cylindrical cartridges with a floating piston member are often used to dispense materials of this type. Such cartridges are placed into a squeeze gun that contains a ratchet mechanism that acts on the floating piston member to force the material out of the opening. This type of arrangement could also be used in conjunction with the principals of the present invention to apply more viscous texture materials such as stucco or the like to wall surfaces.

The scope of the present invention should thus not be determined with reference to the foregoing preferred embodiment.

What is claimed is:

1. A method of patching an untextured portion of a destination surface to substantially match a structure of an existing sprayed on texture pattern on the destination surface surrounding the untextured portion comprising the steps of:

providing texture material comprising a base, a carrier, and particulate material, where the texture material remains in a flowable form when not exposed to air, and when exposed to air, the texture material dries into a hardened form;

providing a tube member defining a container opening;

disposing the texture material within the tube member;

providing a sponge member defining an applicator surface and a sponge opening;

securing the sponge member relative to the tube member such that the container opening and sponge opening are substantially aligned;

forcing the texture material out of the tube member through the container opening and the sponge opening and onto the applicator surface;

displacing the applicator surface of the sponge member such that the texture material on the applicator comes into contact with the untextured portion of the destination surface to transfer texture material in flowable form from the applicator surface to the destination surface;

displacing the applicator surface of the sponge member in a dabbing direction substantially perpendicular to the destination surface such that at least a portion of the particulate material is exposed;

attaching a scraper member to the tube member;

forming a closed end of the container;

forming a retaining opening in the closed end;

forming a latch projection on the scraper member;

engaging the latch projection with the retaining opening;

working the texture material with the scraper member; and allowing the texture material to dry, where the hardened form of the texture material has a structure that substantially matches the structure of the existing sprayed on texture pattern on the destination surface.

2. A method as recited in claim 1, further comprising the steps of:

providing a sponge base defining a base opening;

securing the sponge to the sponge base such that the base opening and the sponge opening are substantially aligned; and securing the sponge base to the tube member such that the base opening and container opening are substantially aligned.

3. A method as recited in claim 1, further comprising the steps of:

providing a cap member; and covering the sponge member with the cap member.

4. A method as recited in claim 1, further comprising the steps of:

forming at least one slot in the scraper member; and arranging the closed end of the container within the at least one slot.

5. A method as recited in claim 1, further comprising the steps of:

forming first and second slots in the scraper member; and arranging the closed end of the container within the first and second slots.

6. A method as recited in claim 1, further comprising the steps of:

forming first and second slots in the scraper member, where the first and second slots define first and second lateral portions and a central portion of the scraper member, where the latch projection is formed in the central portion; and arranging the closed end of the container within the first and second slots.

7. A method as recited in claim 6, in which the central portion is offset from the lateral portions.

8. A dispensing system for patching an untextured portion of a destination surface to substantially match an existing structure of an existing sprayed on texture pattern on the destination surface surrounding the untextured portion comprising:

a container defining a container chamber and a container opening, where texture material comprising a base, a carrier, and particulate material is arranged in the container chamber, where the texture material remains in a flowable form when not exposed to air and, when exposed to air, the texture material dries into a hardened form;

a sponge member defining an applicator surface and a sponge opening, where the sponge member is secured to the container such that the container opening and sponge opening are substantially aligned; and a scraper member detachably attached to the container;

the container comprises a closed end defining a retaining opening; and a latch projection is formed on the scraper member; whereby the latch projection is engaged with the retaining opening; whereby the texture material is forced out of the tube member through the container opening and the sponge opening and onto the applicator surface; and the applicator surface of the sponge member is displaced such that the texture material on the applicator comes into contact with the untextured portion of the destination surface to transfer texture material in flowable form from the applicator surface to the destination surface;

the scraper member is displaced to work the texture material such that a patched structure of the texture material on the untextured portion substantially matches the existing structure;

the texture material dries in the patched structure.

9. A dispensing system as recited in claim 8, further comprising:

a sponge base defining a base opening, where the sponge base supports the sponge such that the base opening and the sponge opening are substantially aligned; and the sponge base is secured to the tube member such that the base opening and container opening are substantially aligned.

10. A dispensing system as recited in claim 8, further comprising a cap member, where the cap member is detachably attached to the cap member to cover the sponge member.

11. A dispensing system as recited in claim 8, in which at least one slot is formed in the scraper member, whereby the closed end of the container is arranged within the at least one slot.

12. A dispensing system as recited in claim 8, in which first and second slots are formed in the scraper member, whereby the closed end of the container is arranged within the first and second slots.

13. A dispensing system as recited in claim 8, further comprising first and second slots in the scraper member, where the first and second slots define first and second lateral portions and a central portion of the scraper member, wherein the latch projection is formed in the central portion; and the closed end of the container is arranged within the first and second slots.

14. A dispensing system as recited in claim 13, in which the central portion is offset from the lateral portions.

15. A dispensing system for patching an untextured portion of a destination surface to substantially match an existing structure of an existing sprayed on texture pattern on the destination surface surrounding the untextured portion comprising:

a container defining a container chamber, a container opening, and a retaining opening, where texture material comprising a base, a carrier, and particulate material is arranged in the container chamber, where the texture material remains in a flowable form when not exposed to air and, when exposed to air, the texture material dries into a hardened form;

a sponge member defining an applicator surface and a sponge opening, where the sponge member is secured to the container such that the container opening and sponge opening are substantially aligned; and a scraper member comprising a latch projection for engaging the retaining opening to detachably attach the scraper member to the container; whereby the texture material is forced out of the tube member through the container opening and the sponge opening and onto the applicator surface; and the applicator surface of the sponge member is displaced such that the texture material on the applicator comes into contact with the untextured portion of the destination surface to transfer texture material in flowable form from the applicator surface to the destination surface;

the scraper member is displaced to work the texture material such that a patched structure of the texture material on the untextured portion substantially matches the existing structure;

the texture material dries in the patched structure.

16. A dispensing system as recited in claim 15, further comprising:

a sponge base defining a base opening, where the sponge base supports the sponge such that the base opening and the sponge opening are substantially aligned; and the sponge base is secured to the tube member such that the base opening and container opening are substantially aligned.

17. A dispensing system as recited in claim 15, in which first and second slots are formed in the scraper member, whereby the closed end of the container is arranged within the first and second slots.

* * * * *